US009751659B1

(12) United States Patent
Malley

(10) Patent No.: US 9,751,659 B1
(45) Date of Patent: Sep. 5, 2017

(54) BEVERAGE COOLER ORGANIZER SYSTEMS

(71) Applicant: Anthony Malley, Oceanville, NJ (US)

(72) Inventor: Anthony Malley, Oceanville, NJ (US)

( * ) Notice: Subject to any disclaimer, the term of this patent is extended or adjusted under 35 U.S.C. 154(b) by 0 days.

(21) Appl. No.: 15/292,963

(22) Filed: Oct. 13, 2016

(51) Int. Cl.

| | |
|---|---|
| ***A47F 1/04*** | (2006.01) |
| ***B65D 21/02*** | (2006.01) |
| ***A47G 23/02*** | (2006.01) |
| ***A47G 29/00*** | (2006.01) |
| ***A47B 81/00*** | (2006.01) |
| *A47F 5/08* | (2006.01) |
| *A47B 73/00* | (2006.01) |

(52) U.S. Cl.
CPC ..... *B65D 21/0224* (2013.01); *A47B 81/00* (2013.01); *A47G 23/0216* (2013.01); *A47G 23/0241* (2013.01); *A47G 29/00* (2013.01); *A47B 73/00* (2013.01); *A47F 1/04* (2013.01); *A47F 5/08* (2013.01); *A47G 2023/0291* (2013.01)

(58) Field of Classification Search
CPC ..... B65D 21/0224; A47G 23/0216; A47G 23/0241; A47G 29/00; A47G 2023/0291; A47F 1/04; A47F 5/08; A47B 81/00; A47B 73/00
USPC ..... 211/70.5, 87.01, 123, 113, 17–24, 184, 211/12; D6/552, 553, 566, 512, 567; 206/139; 220/737–739
See application file for complete search history.

(56) References Cited

U.S. PATENT DOCUMENTS 411,938 A * 10/1889 Suggett ..... A47G 25/0692 211/123
428,085 A * 5/1890 Friedmann ..... A47G 25/0692 211/113
533,276 A * 1/1895 Crone ..... A47G 25/0692 105/354
597,507 A * 1/1898 McIntosh ..... B62H 3/12 211/19
610,656 A * 9/1898 Martin ..... B62H 3/12 211/104
614,503 A * 11/1898 Sackett ..... B62H 3/12 211/17
766,934 A * 8/1904 Danhour ..... A47K 1/09 211/65
1,277,827 A * 9/1918 Barber ..... A47C 29/006 135/137
2,261,280 A * 11/1941 Pennebaker ..... A47F 7/04 211/24
2,400,807 A * 5/1946 Burkhard ..... A47F 5/0876 211/87.01
2,513,806 A * 7/1950 Kennedy ..... A47J 47/16 211/104
2,529,287 A * 11/1950 Garwood ..... A47L 19/04 211/75
2,928,549 A * 3/1960 Nenwirth ..... A47L 23/20 211/34

(Continued)

*Primary Examiner* — Joshua J Michener
*Assistant Examiner* — Devin Barnett
(74) *Attorney, Agent, or Firm* — RG Patent Consulting, LLC; Rachel Gilboy

(57) ABSTRACT

A combination of beverage coolers and a beverage cooler organizer system that includes a U-shaped wire connected to a base that holds the beverage coolers in a stacked and organized manner to provide convenient access to the beverage coolers when needed.

7 Claims, 6 Drawing Sheets

(56) References Cited

U.S. PATENT DOCUMENTS 3,227,503 A * 1/1966 Fletcher ..... A47F 7/0021 211/60.1
3,385,451 A * 5/1968 Anderson ..... A47F 7/0021 211/184
D213,975 S * 4/1969 Woerner ..... D6/320
4,231,501 A * 11/1980 Goode ..... B60R 9/12 211/70.5
4,376,486 A * 3/1983 Arcadi, Jr. ..... A47F 7/08 211/35
4,410,093 A * 10/1983 Chiariello et al. ..... B42F 17/12 211/11
4,515,332 A * 5/1985 Scharfy ..... A47G 21/14 211/70.6
4,541,535 A * 9/1985 Bartholomew ..... B68C 1/002 211/85.11
4,679,695 A * 7/1987 Leff ..... A47G 7/041 211/74
D296,842 S * 7/1988 Daigle ..... D6/552
4,902,000 A * 2/1990 Starks et al. ..... A63B 3/00 434/255
4,991,723 A * 2/1991 Elkins ..... A47B 81/005 211/106.01
5,076,442 A * 12/1991 Hakeem ..... A47B 46/00 211/162
5,096,068 A * 3/1992 Theriault ..... B62H 3/04 211/20
5,201,426 A * 4/1993 Cruwell, Jr. ..... A47F 10/04 211/17
D340,826 S * 11/1993 Deom ..... D6/567
D341,512 S * 11/1993 Dauwalder ..... D6/552
D345,257 S * 3/1994 Dunlop ..... D6/316
D361,449 S * 8/1995 Rittenberg ..... D6/566
5,538,489 A * 7/1996 Magid ..... A47D 13/04 482/54
5,743,413 A * 4/1998 Noll ..... A47B 45/00 211/175
5,816,818 A * 10/1998 Wun ..... A63B 22/0605 434/29
D407,908 S * 4/1999 Dickinson et al. ..... D6/320
D416,734 S * 11/1999 Lannon et al. ..... D6/514
6,102,215 A * 8/2000 Guida ..... B25H 3/04 206/384
6,293,412 B1 * 9/2001 Draper ..... E05B 73/00 211/4
6,330,948 B1 * 12/2001 Leto ..... A47J 47/20 211/65
D486,682 S * 2/2004 Zins ..... D6/535
6,712,226 B1 * 3/2004 Williams, Jr. ..... A47B 81/00 211/70.5
6,729,481 B1 * 5/2004 O'Brien ..... A47B 73/00 211/74
6,763,956 B2 * 7/2004 Woods ..... A47B 73/00 211/74
6,814,333 B1 * 11/2004 Freiburger ..... F16M 11/38 248/150
7,055,834 B1 * 6/2006 White ..... A47B 31/00 280/35
7,150,361 B2 * 12/2006 Calleja ..... A47F 7/0021 182/112
7,188,738 B2 * 3/2007 Stafford ..... G09F 7/08 211/10
7,243,884 B2 * 7/2007 Lawson ..... D06F 95/002 211/12
7,268,698 B2 * 9/2007 Hart ..... A47J 31/007 340/870.07
D569,131 S * 5/2008 Cohen ..... D6/675.5
D575,090 S * 8/2008 Van Beuningen ..... D6/553
D586,957 S * 2/2009 Rutherford ..... D30/119
7,520,397 B1 * 4/2009 Segale ..... A47B 81/04 211/106
D632,529 S * 2/2011 Chen ..... D6/566
D637,840 S * 5/2011 Stephens ..... D6/513
D646,901 S * 10/2011 Higgins ..... D6/300
D660,063 S * 5/2012 Herrera Rodriguez ..... D6/566
8,607,994 B1 * 12/2013 Schneider ..... A47B 73/00 211/106
8,640,890 B2 * 2/2014 Schiller ..... B65B 67/1227 211/12
8,671,545 B1 * 3/2014 Zimmerman ..... F16M 13/02 211/123
8,800,789 B2 * 8/2014 Sharp ..... A47F 7/02 211/85.2
8,915,381 B2 * 12/2014 Brozak ..... A47F 5/0056 108/61
D749,872 S * 2/2016 Gonzalez ..... D6/552
2004/0084460 A1 * 5/2004 Scheetz, II ..... B65D 81/3879 220/739
2005/0061156 A1 * 3/2005 Hart ..... A47J 31/007 99/275
2005/0161418 A1 * 7/2005 Lynch ..... A47F 5/0056 211/119.003
2006/0054578 A1 * 3/2006 Musico ..... A47J 47/16 211/105.1
2007/0163972 A1 * 7/2007 Sopel ..... B60P 7/15 211/60.1
2007/0241071 A1 * 10/2007 Antonioni ..... A47F 5/0807 211/87.01
2008/0011694 A1 * 1/2008 Garceau ..... A63C 11/028 211/13.1
2008/0164269 A1 * 7/2008 Vorderkunz ..... B65D 81/3874 220/739
2008/0258912 A1 * 10/2008 King ..... G08B 13/1409 340/540
2009/0159770 A1 * 6/2009 Sugarman ..... A47B 97/001 248/310
2010/0288808 A1 * 11/2010 Marr, Jr. ..... B60R 9/00 224/403
2011/0239365 A1 * 10/2011 Grant ..... A47K 3/003 4/576.1
2012/0106130 A1 * 5/2012 Beaudette ..... A47G 23/0309 362/92
2012/0193366 A1 * 8/2012 Miller ..... F25D 3/08 220/592.17
2012/0285973 A1 * 11/2012 Hargett ..... B65D 81/3876 220/592.24
2013/0092643 A1 * 4/2013 Friemann ..... B62H 3/04 211/19
2014/0246402 A1 * 9/2014 Tschanen ..... B27C 3/02 217/6
2014/0263122 A1 * 9/2014 Roberts ..... A47B 46/005 211/88.01
2015/0090676 A1 * 4/2015 Florek ..... A47G 1/12 211/13.1
2015/0101525 A1 * 4/2015 Curts ..... B63B 17/00 114/343
2015/0128518 A1 * 5/2015 Knight ..... E04F 13/0864 52/404.1
2016/0213181 A1 * 7/2016 Gonzalez, II ..... B65D 25/36
2017/0000275 A1 * 1/2017 Brown ..... G09F 23/04

* cited by examiner

BEVERAGE COOLER ORGANIZER SYSTEMS

CROSS-REFERENCE TO RELATED APPLICATION

The current application Ser. No. 15/292,963 is a Continuation-in-Part (CIP) of application Ser. No. 14/607,029.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

The following includes information that may be useful in understanding the present invention(s). It is not an admission that any of the information provided herein is prior art, or material, to the presently described or claimed inventions, or that any publication or document that is specifically or implicitly referenced is prior art.

BACKGROUND OF THE INVENTION

1. Field of the Invention

The present invention relates generally to the field of organizers and more specifically relates to a beverage cooler organizer to organize beverage coolers for cans and bottles.

2. Description of the Related Art

Many individuals in modern society utilize beverage coolers to keep their beverage of choice cold while in the process of consuming it. Anyone who uses a beverage cooler to keep their beverage cold, typically has a collection of beverage coolers they have gathered over time. Unfortunately, these beverage coolers, when not in use, are usually unorganized and scattered around, or inconveniently stuffed in a cabinet or drawer, taking up much needed space, and making it difficult to find them when needed. An easy to access solution is desirable.

Various attempts have been made to solve the above-mentioned problems such as those found in U.S. Pat. No. 7,520,397 to Joyce M. Segale; U.S. Pat. No. 4,679,695 to Thomas E. Leff; and U.S. Pat. No. 2,529,287 to Garwood Ernest C. This prior art is representative of organizers. None of the above inventions and patents, taken either singly or in combination, is seen to describe the invention as claimed.

Ideally, a cooler organizer should provide ease of use and, yet, would operate reliably and be manufactured at a modest expense. Thus, a need exists for a reliable beverage cooler organizer system to securely store cooler organizers, and eliminate unnecessary clutter around a house, in drawers and cabinets, and to avoid the above-mentioned problems.

BRIEF SUMMARY OF THE INVENTION

In view of the foregoing disadvantages inherent in the known organizer art, the present invention provides a novel beverage cooler organizer system. The general purpose of the present invention, which will be described subsequently in greater detail is to provide a place to securely store and organize beverage cooler means, and eliminate excess clutter in drawers and cabinets of a home.

A beverage cooler organizer system is disclosed herein, in a preferred embodiment, comprising: a beverage cooler assembly having a base section, a top side, a bottom side, and a U-shaped wire. The beverage cooler assembly comprises the base section and U-shaped wire in combination. The U-shaped wire is perpendicularly and fixably attached to the base section to allow beverage coolers to be removably attached in an organized manner, thereby eliminating excess clutter. The base section preferably comprises a durable wood, and alternately a suitable variation thereof, and has mount holes drilled in the top side of the base section to receive the U-shaped wire. The mount holes of the base section are filled with a strong adhesive to fixably mount the U-shaped wire vertically therefrom. The bottom side of the base section is substantially flat to allow secure placement of the beverage cooler organizer assembly on a flat planer surface. The U-shaped wire may comprise a heavy gauge, ferrous material, and alternately a suitable variation of, able to maintain its shape. The U-shaped wire ends are spaced apart so beverage coolers (koosies) are able to be securely and removably attached, and provides convenient access to beverage coolers as needed by a user.

A cooler organizer system is also disclosed herein, in a preferred embodiment comprising: a cooler organizer assembly having a top end, a bottom end, and dowels. The top end comprises a top portion, and a bottom portion having parallel mount holes. The bottom end comprises an inner side having parallel drill holes, and an outer side. The dowels have a first end, and a second end. The cooler organizer assembly comprises the top end, bottom end, and dowels in combination. The first end of the dowels are fixably attached to the bottom portion of the top end via parallel mount holes. The second end of the dowels are fixably attached to the inner side of the bottom end via parallel drill holes allowing beverage coolers to be removably attached on the dowels in an organized manner. The cooler organizer assembly is a free standing unit, able to be placed on a substantially flat planer surface for use and comprises a durable wood, and alternately a suitable variation thereof. The dowels are fixably attached to the top end parallel mount holes, and the bottom end parallel drill holes via a strong adhesive, and are spaced apart so that beverage coolers are able to be securely and removably attached until needed for use.

An organizer system in a second alternate embodiment comprises: an organizer assembly having first end, second end, dowel rods, and mount plate. First end comprises a side, and b side having dowel rod holes. Second end comprises c side having dowel rod mount holes, and d side. Dowel rods have first side and second side. Mount plate is attached to first end and second end. First side of dowel rods are fixably attached to b side of first end via dowel rod holes with a strong adhesive. Second side of dowel rods are fixably attached to c side of second end via dowel rod mount holes with a strong adhesive. Mount plate is perpendicularly attached to first end and second end to facilitate mounting of organizer assembly to a substantially vertical flat planer surface, and alternately under a cupboard as needed for use. Beverage coolers are then able to be attached to dowel rods in an organized and space saving manner until needed for use. Organizer assembly comprises durable wood, and alternately a suitable variation thereof, and provides convenient storage and access of beverage coolers as needed.

Further, an organizer system is disclosed herein, in a preferred embodiment comprising: an organizer assembly having a mount plate having a back side, a front side with wire mount holes, and a set of organizer wires. The set of organizer wires may be fixably attached to the front side of the mount plate, and are of a suitable, heavy gauge to allow retention of shape as needed. The organizer wires are attached to the wire mount holes in a parallel fashion to allow removable attachment of beverage coolers in an organized and space saving manner. The organizer wires are attached to the mount plate via the wire mount holes with a strong adhesive for longevity of use, and is able to be mounted on a substantially vertical surface; alternately this embodiment may be mounted under a cupboard for use as needed. The mount plate may comprise a durable wood, and alternately a suitable variation thereof, and a heavy gauge wire combination for longevity of use. Beverage coolers are able to be placed between organizer wires for secure placement and storage until needed for use, and provide convenient storage and access of beverage coolers as needed. Certain embodiments may be in a carousel design.

The present invention holds significant improvements and serves as a beverage cooler organizer system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, beverage cooler organizer system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to an organizer device and more particularly to a beverage cooler organizer as used to improve the efficiency of a user to store and organize beverage coolers.

Generally speaking, the beverage cooler organizer system of the present invention provides users with a neat and systematic way to store and organize beverage coolers, and have convenient access when needed. It eliminates disarray and clutter around a house, kitchen or bar from beverage coolers.

Figure 1A:
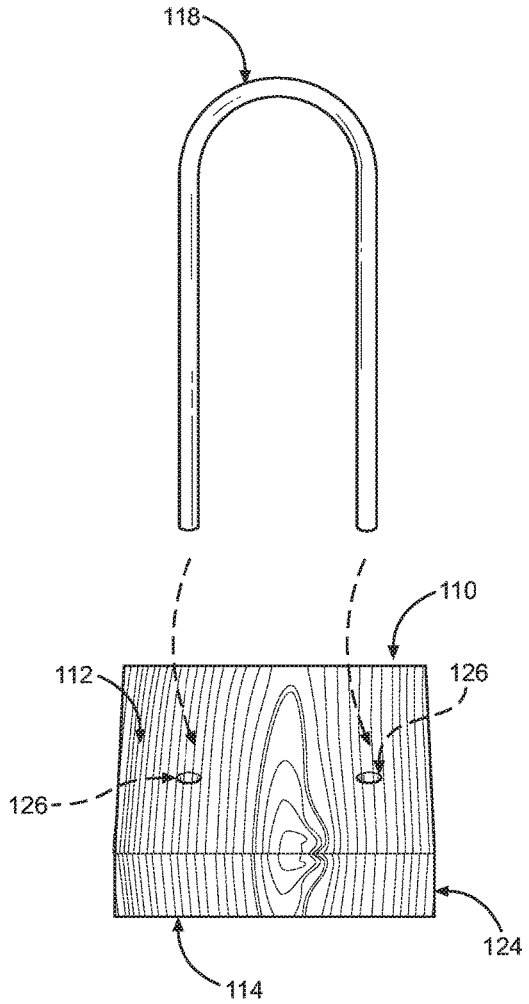
FIG. 1A and FIG. 1B show perspective views illustrating a beverage cooler organizer system in a before use and an in-use condition, respectively, according to an embodiment of the present invention.
Figure 1B:
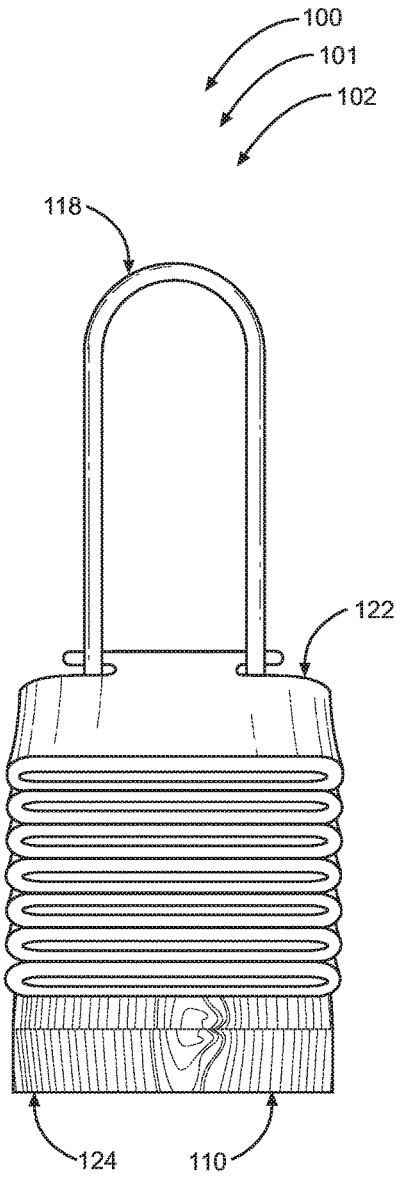

Referring to the drawings by numerals of reference there is shown in FIG. 1A, and FIG. 1B, perspective views illustrating an in-use condition 101 of beverage cooler organizer system 100 according to an embodiment of the present invention.

Beverage cooler organizer system 100 comprises: beverage cooler assembly 102 having base section 110, top side 112, bottom side 114, and U-shaped wire 118. The beverage cooler assembly comprises the base section and U-shaped wire 118 in combination. U-shaped wire 118 is perpendicularly and fixably attached to base section 110 to allow beverage holders 122 to be removably attached in an organized manner, thereby eliminating excess clutter. Base section 110 comprises a durable wood 124, and alternately a suitable variation thereof, and has mount holes 126 drilled in top side 112 of base section 110 to receive U-shaped wire 118. Mount holes 126 of base section 110 are filled with a strong adhesive to fixably mount U-shaped wire 118. Bottom side 114 of base section 110 is substantially flat to allow secure placement of beverage cooler organizer assembly 102 on a flat planer surface. U-shaped wire 118 comprises a heavy gauge, ferrous material, and alternately a suitable variation of, able to maintain its shape. U-shaped wire 118 ends are spaced apart so beverage holders 122 are able to be securely and removably attached, and provides convenient access to beverage holders 122 as needed.

Figures 2A, 2B, 2C:
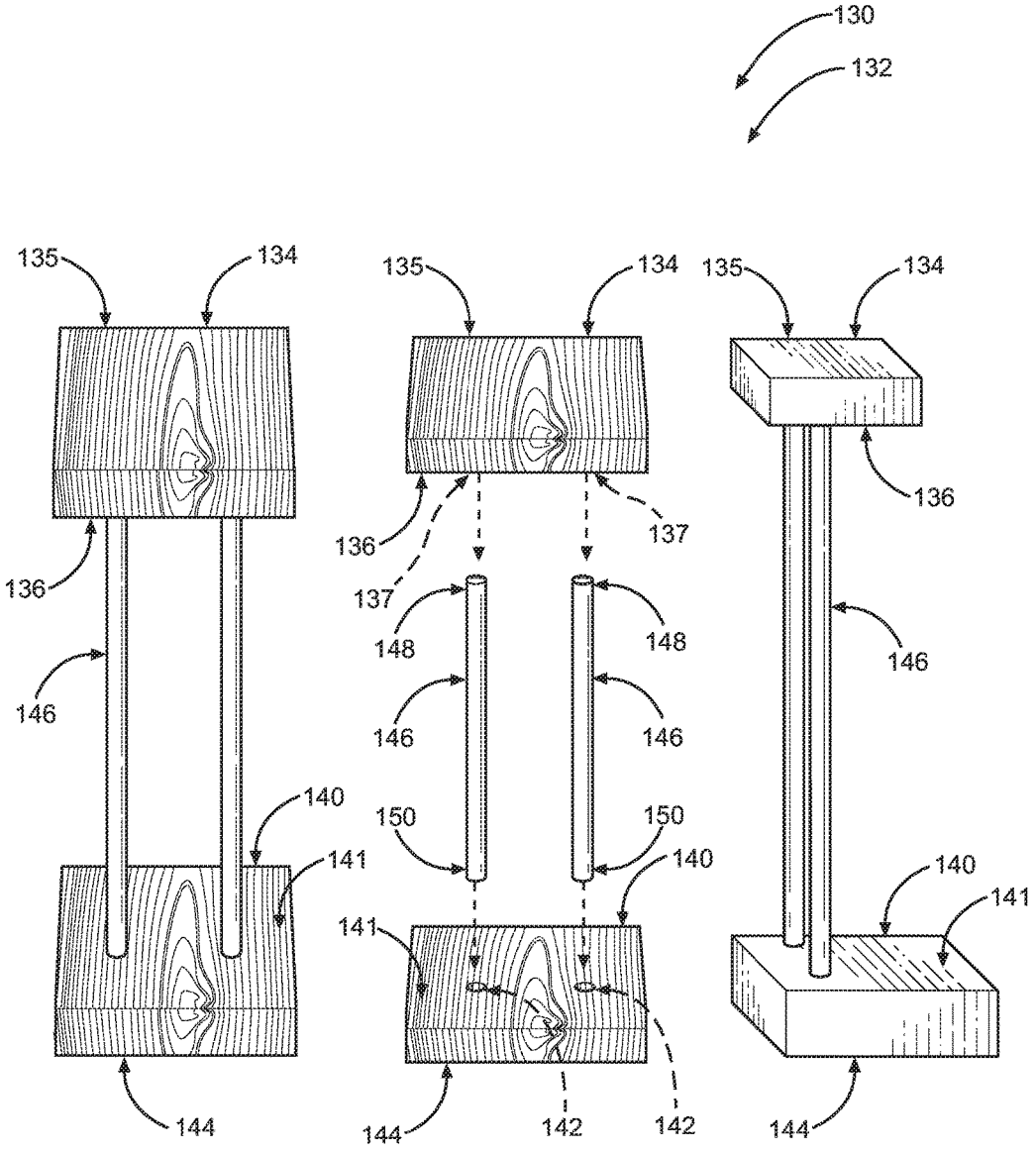
FIG. 2A, FIG. 2B, and FIG. 2C, are perspective views illustrating the beverage cooler organizer assembly according to an alternate embodiment of the present invention of FIG. 1.

Referring now to FIG. 2A, FIG. 2B, and FIG. 2C, perspective views illustrating an alternate embodiment of beverage cooler organizer system 100 according to an embodiment of the present invention.

Cooler organizer system 130 in an alternate embodiment comprises: cooler organizer assembly 132 having top end 134, bottom end 140, and dowels 146. Top end 134 comprises top portion 135, and bottom portion 136 having parallel mount holes 137. Bottom end 140 comprises inner side 141 having parallel drill holes 142, and outer side 144. Dowels 146 have first end 148, and second end 150. Cooler organizer assembly 132 comprises top end 134, bottom end 140, and dowels 146 in combination. First end 148 of dowels 146 are fixably attached to bottom portion 136 of top end 134 via parallel mount holes 137. Second end 150 of dowels 146 are fixably attached to inner side 141 of bottom end 140 via parallel drill holes 142 allowing beverage holders 122 to be removably attached on dowels 146 in an organized manner. Cooler organizer assembly 132 is a free standing unit, able to be placed on a substantially flat planer surface for use and comprises durable wood 124, and alternately a suitable variation thereof. Dowels 146 are fixably attached to top end 134 parallel mount holes 137, and bottom end 140 parallel drill holes 142 via a strong adhesive, and are spaced apart so beverage holders 122 are able to be securely and removably attached until needed for use.

Figure 3A:
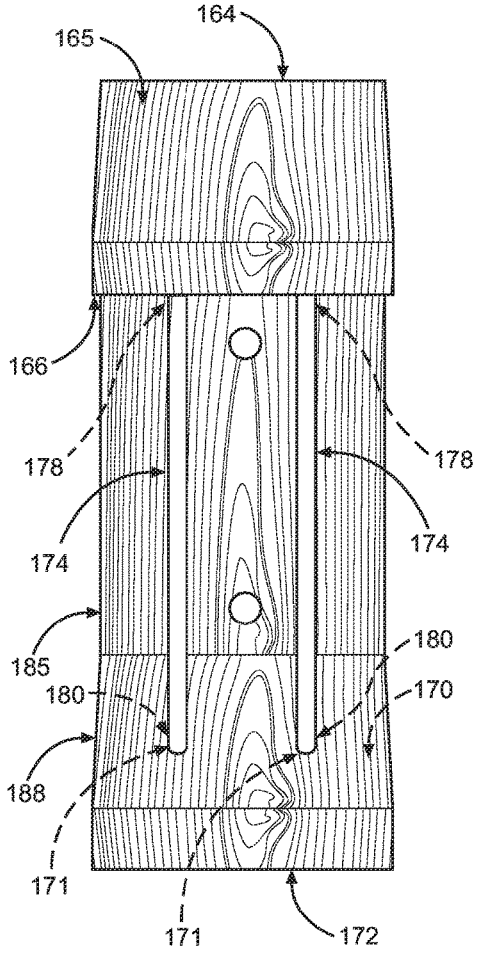
FIG. 3A and FIG. 3B are perspective views illustrating another alternate embodiment of the beverage cooler organizer assembly of the present invention of FIG. 1.
Figure 3B:
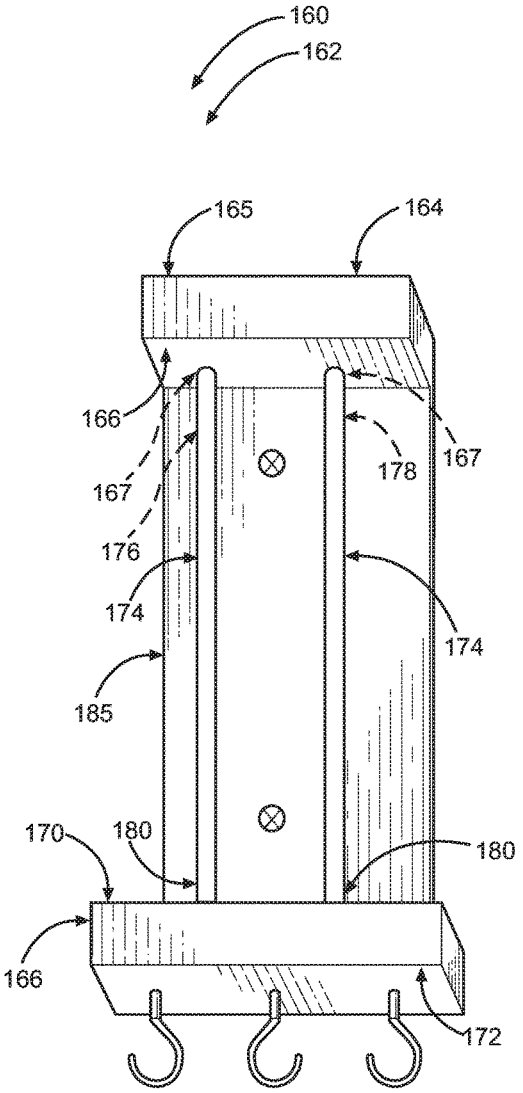

Referring now to FIG. 3A and FIG. 3B, perspective views illustrating another alternate embodiment of beverage cooler organizer system 100 according to an embodiment of the present invention.

A cooler organizer system 130 in a third alternate embodiment comprises: an organizer assembly 162 having first end 164, second end 168, dowel rods 174, and mount plate 185. First end 164 comprises a side 165, and b side 166 having dowel rod holes 167. Second end 168 comprises c side 170 having dowel rod mount holes 171, and d side 172. Dowel rods 174 have first side 178 and second side 180. Mount plate 185 is attached to first end 164 and second end 168. First side 178 of dowel rods 174 are fixably attached to b side 166 of first end 164 via dowel rod holes 167 with a strong adhesive. Second side 180 of dowel rods 174 are fixably attached to c side 170 of second end 168 via dowel rod mount holes 171 with a strong adhesive. Mount plate 185 is perpendicularly attached to first end 164 and second end 168 to facilitate mounting of organizer assembly 162 to a substantially vertical flat planer surface, and alternately under a cupboard as needed for use. Beverage holders 122 are then able to be attached to dowel rods 174 in an organized and space saving manner until needed for use. Organizer assembly 162 comprises durable wood 124, and alternately a suitable variation thereof, and provides convenient storage and access of beverage holders 122 as needed.

Figure 4A:
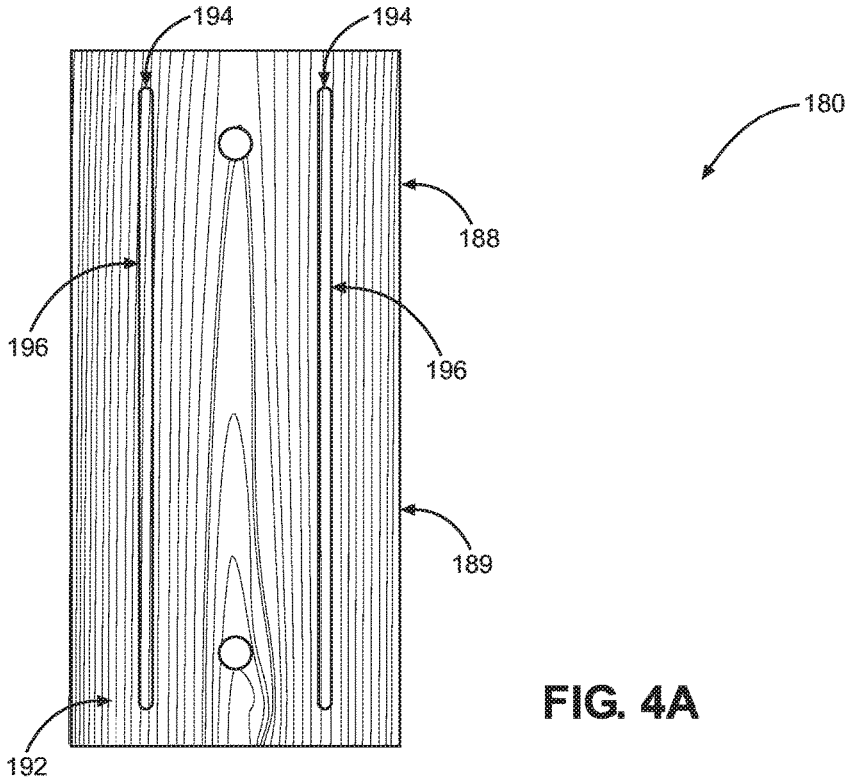
FIG. 4A and FIG. 4B, are perspective views illustrating organizer systems according to an embodiment of the present invention of FIG. 1.
Figure 4B:
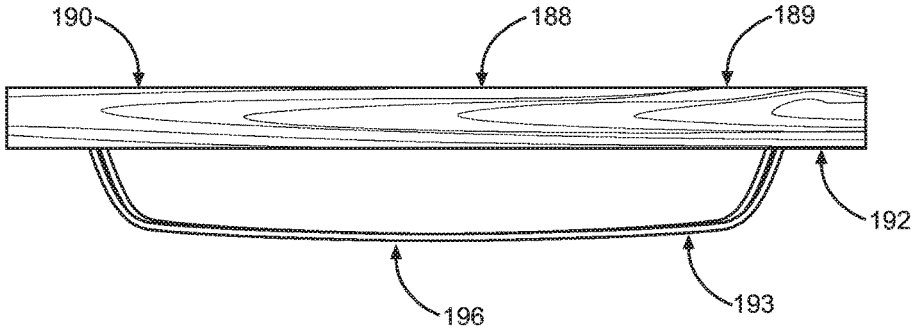
Figure 6:
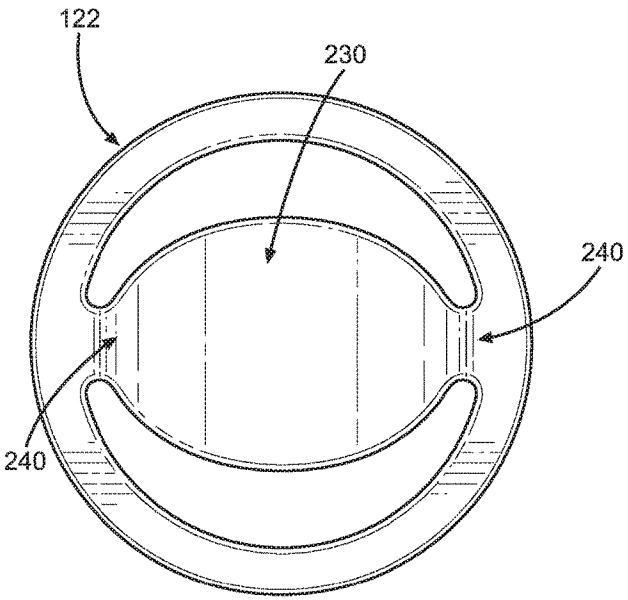
FIG. 6 is a bottom view illustrating the beverage cooler according to an embodiment of the present invention of FIG. 4.
Figure 5:
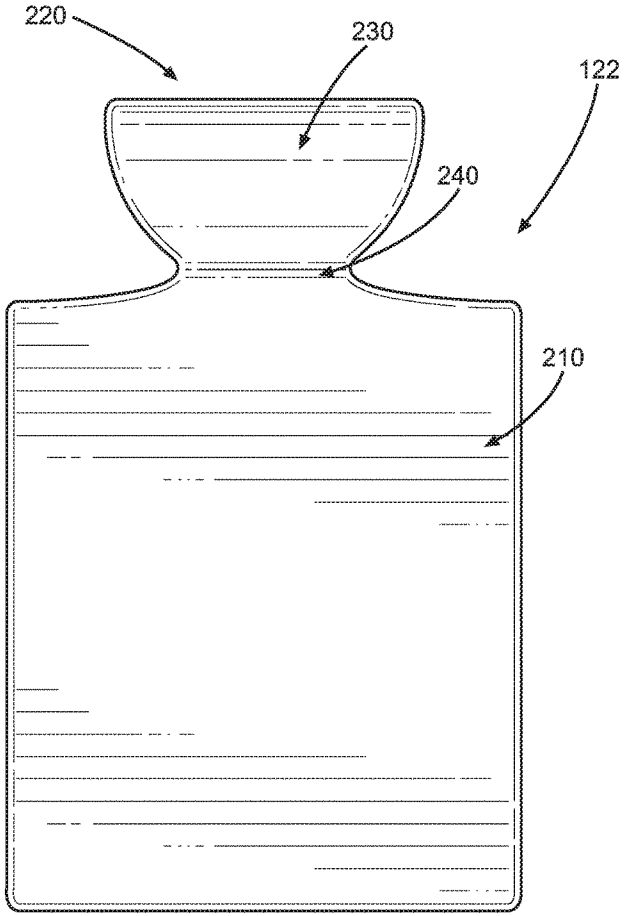
FIG. 5 is a side view illustrating the beverage cooler according to an embodiment of the present invention of FIG. 4.
Figure 8:
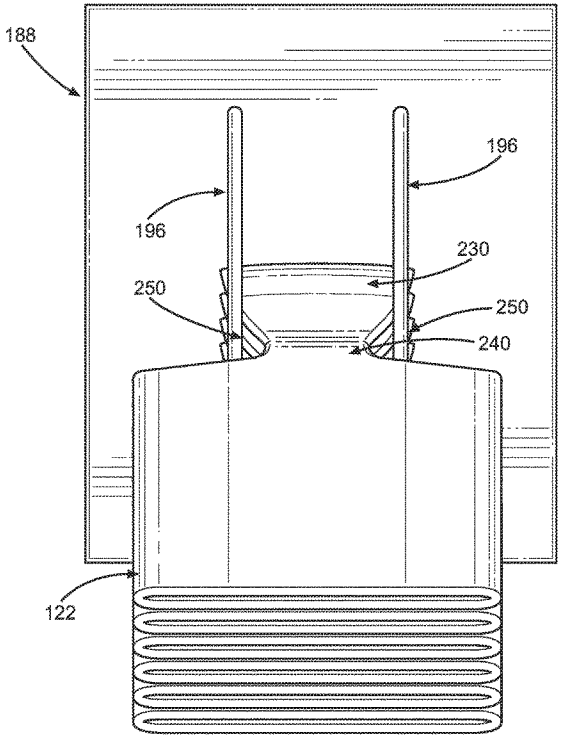
FIG. 8 is a front perspective view illustrating the beverage cooler organizer assembly holding a plurality of beverage coolers according to an embodiment of the present invention of FIG. 4.
Figure 7:
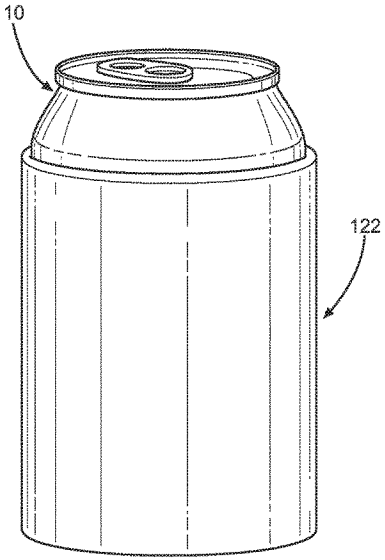
FIG. 7 is a side view illustrating the beverage cooler holding a beverage therein according to an embodiment of the present invention of FIG. 4.

Referring now to FIG. 4A, and FIG. 4B, showing further embodiments of beverage cooler organizer system 100 according to an embodiment of the present invention.

Organizer system 160 in yet another alternate embodiment comprises: an organizer assembly 162 having base plate 188 having back side 190, front side 192 with wire mount holes 194, and a set of organizer wires 196. The set of organizer wires 196 are fixably attached to front side 192 of base plate 188, and are of a suitable, heavy gauge to allow retention of shape as needed. Organizer wires 196 are attached to base plate 188 via wire mount holes 194 in a parallel fashion to allow removable attachment of beverage coolers in an organized and space saving manner. Organizer wires 196 are attached to base plate 188 via wire mount holes 194 with a strong adhesive for longevity of use, and is able to be mounted on a substantially vertical surface, and alternately under a cupboard for use as needed by a user. Base plate 188 comprises durable wood 189, and alternately a suitable variation thereof, and heavy gauge wire 193 combination for longevity of use. Beverage coolers are able to be placed between organizer wires 196 for secure placement and storage until needed for use, and provide convenient storage and access of beverage coolers as needed. Certain embodiments may be in a carousel design.

Referring to FIGS. 5-8, the beverage holder 122 is formed having a main body portion 210 having a cylindrical shape adapted to hold a beverage container 10 and is adapted to fold into a flat configuration, and a base portion 220 connected to a bottom portion of the main body portion and is shaped and adapted to fold into a flat configuration forming a knob portion 230 and a neck portion 240. The knob portion is formed having a width that is larger than the width of the neck portion. Further, the U-shaped wire includes two spaced wire portions 250, such that the distance of the space between the two spaced wire portions 250 is less than the width of each knob portion 230 of each of beverage cooler and is greater than the width of the neck portion 240 of each beverage cooler, such that when the plurality of beverage coolers are folded each neck portion of each beverage holder 122 can be placed between the two spaced wire portions 250, such that the knob portion of each beverage coolers is on one side of the two spaced wire portions and the main body portion of each beverage cooler is on an opposite side of the two spaced wire portions, such that the beverage coolers can be folded and held by the beverage cooler organizer assembly in a stacked configuration.

Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is sent forth in the appended claims:

1. A wall mountable beverage holder organizer system comprising a plurality of beverage holders, each beverage holder fabricated from a material that acts as an insulator to keep beverages stored therein cold, each beverage holder comprising:

a main body portion having a first width; wherein each main body portion is formed having a cylindrical shape that is configured to receive a beverage can or bottle therein; wherein the main body portion is configured to fold into a flat configuration when not in use; and a base portion; wherein said base portion extends from a bottom portion of said main body portion and is shaped and adapted to fold into a flat configuration forming a knob portion having a second width and a neck portion having a third width, wherein the second width is larger than the third width and the first width is larger than the second width; and a wall mountable beverage holder organizer having:

a base plate, said base plate having a front side and a rear side configured to be mounted to a wall;

and two U-shaped wires;

wherein said U-shaped wires are perpendicularly and fixably attached to the front side of said base plate; wherein said U-shaped wires are spaced apart, wherein the distance of said space between said two spaced wire portions is less than said second width of each said knob portion of each said plurality of beverage holders and is greater than said third width of said neck portion of each said plurality of beverage holders;

wherein when said plurality of beverage holders are folded each said neck portion of each of said plurality of beverage holders is configured to be wedged between said two spaced wire portions, such that said knob portion of each said plurality of beverage holders is on one side of said two spaced wire portions and said main body portion of each of said plurality of beverage holders is on an opposite side of said two spaced wire portions, such that each of said plurality of beverage holders can be folded and suspended from said beverage holder organizer in a stacked configuration; wherein the beverage holders are able to be securely and removably attached to the beverage holder organizer until needed for use.

2. The beverage holder organizer system of claim 1 wherein said base plate comprises wood.

3. The beverage holder organizer system of claim 2 wherein said base plate comprises mount holes drilled in said front side of said base plate to receive said U-shaped wires.

4. The beverage holder organizer system of claim 3 wherein said mount holes of said base plate are filled with an adhesive to fixably mount said U-shaped wires.

5. The beverage holder organizer system of claim 3 wherein said rear side of said base plate is substantially flat to allow secure placement of said beverage holder organizer on a flat planer surface.

6. The beverage holder organizer system of claim 4 wherein said U-shaped wires are fabricated from a ferrous material which is configured to maintain its original shape.

7. The beverage holder organizer system of claim 1 wherein said beverage holder organizer provides access to the beverage holders as needed by a user.

* * * * *